US005903198A

United States Patent [19]

Weiss

[11] Patent Number: 5,903,198

[45] Date of Patent: May 11, 1999

[54] PLANAR GYRATOR

[75] Inventor: Jerald A. Weiss, Wayland, Mass.

[73] Assignee: Massachusetts Institute of Technology, Cambridge, Mass.

[21] Appl. No.: 08/902,702

[22] Filed: Jul. 30, 1997

[51] Int. Cl.[6] ..... H01P 1/32

[52] U.S. Cl. ..... 333/24.1; 333/995

[58] Field of Search ..... 333/1.1, 24.1, 333/24.2, 102, 26

[56] References Cited

U.S. PATENT DOCUMENTS

| | | | |
|---|---|---|---|
| 3,986,149 | 10/1976 | Harris et al. | 333/24.1 X |
| 4,521,753 | 6/1985 | Schloemann | 333/24.1 X |
| 5,223,808 | 6/1993 | Lee et al. | 333/24.1 |
| 5,484,765 | 1/1996 | Dionne et al. | 505/210 |
| 5,808,518 | 9/1998 | McKenzie, III et al. | 333/26 |

OTHER PUBLICATIONS

Tellegen, B.D.H., (Apr., 1948) "The Gyrator, a New Electric Network Element," *Phillips Research Reports* 3: 81–101.

Polder, D., (1949) "On the Theory of Ferromagnetic Resonance," *Phil Mag,* 40: 99.

Hogan, C. L. (Jan., 1952) "The Ferromagnetic Faraday Effect at Microwave Frequencies and its Applications," *The Bell System Technical Journal* 31(1).

Hogan, C. L. (Jan., 1953) "Ferromagnetic Faraday Effect at Microwave Frequencies and its Applications," *Reviews of Modern Physics* 25(1): 253–263.

Carlin, H. J. (May, 1955) "On the Physical Realizability of Linear Non–Reciprocal Networks," *Proceedings of the IRE*: 608–616.

Weiss, J.A. (May, 1960) "Tetrahedral Junction," *Journal of Applied Physics Supplement* 31(5): 168S–169S.

Mesa, F. (1991) "Rigurous Analysis of Non–Reciprocal Slow–Wave Planar Transmission Lines," *21st European Microwave Conference* 1: 229–234.

Fitzgerald, W. D. (1992) "A 35–GHz Beam Waveguide System for the Millimeter–Wave Radar,"*The Lincoln Laboratory Journal* 5(2): 245–271.

Lax, B. (Dec., 1993) "Quasi–Optical Ferrite Reflection Circulator," *IEEE Transactions on Microwave Theory and Techniques* 41(12): 2190–2197.

Weiss, J. A. et al. (Jan. 10, 1994) "Quasi–optical Reflection Circulator: Progress in Theory and Millimeter–Wave Experiments," *International Society for Optical Engineering,* 2211: 416–427.

Bloch, F., et al., "The Nuclear Induction Experiment" *Phys. Rev.* vol. 70, Nos. 7 & 8, (1946), pp. 474–485.

Kittel, C., "On the Theory of Ferromagnetic Resonance Absorption," *Phys. Rev.* vol. 73, No. 2, (1948) pp. 155–161.

Kittel, C., "On the Gyromagnetic Ratio and Spectroscopic Splitting Factor of Ferromagnetic Susbstances," *Phys. Rev.* vol. 76, No. 6, (1949) pp. 743–748.

(List continued on next page.)

*Primary Examiner*—Paul Gensler
*Attorney, Agent, or Firm*—Lappin & Kusmer LLP

[57] ABSTRACT

In a planar gyrator, parallel transmission lines are positioned proximal to a magnetized gyrotropic substrate. Input and output transducers couple the ends of the transmission lines to corresponding input and output ports. The input and output transducers are configured to excite first and second partial wave fields on the transmission lines of similar or different phases respectively. The wave fields, in turn, interact gyromagnetically with the substrate, such that the resultant difference in phase change for a first wave propagating from the first to the second port and a second wave propagating from the second to the first port is an odd-integer multiple of 180 degrees. Alternatively, if the magnetization of the substrate is reversed, the phase of a wave propagating from the first to the second port is changed by 180 degrees. The planar gyrator is amenable to application in miniaturized planar microwave devices, for example as a magnetically-controlled phaser or switch, or as a component in a circulator or isolator implemented in planar microwave technology.

29 Claims, 10 Drawing Sheets

OTHER PUBLICATIONS

Ramsey, N.F. "Paramagnetic and Ferromagnetic Resonance," *Nuclear Moments,* John Wiley & Sons, Inc., (1953), pp. 129–136.

Lax, B., et al., "Farraday–Rotation Devices: Physical Description," *Microwave Ferrites and Ferrimagnetics;* McGraw–Hill, Sec. 12–1, (1962) pp. 544–549.

Roome, G.T., et al., "Thin Ferrite Devices for Microwave Integrated Circuits," *IEEE Transactions on Microwave Theory and Techniques,* vol. MIT–16, No. 7, (1968) pp. 411–420.

Rosenbaum, F.J., "Integrated Ferrimagnetic Devices," *Advances in Microwaves,* vol. 8, Academic Press (1968) pp. 203–294.

PLANAR GYRATOR

GOVERNMENT SUPPORT

The United States government has rights in this invention pursuant to Contract Number F19628-95-C-0002, awarded by the United States Air Force.

BACKGROUND OF THE INVENTION

The term gyrator was introduced by Tellegen to designate the concept of a circuit element embodying the essence of nonreciprocity:

1. B. D. H. Tellegen: "The Gyrator, a New Electric Network Element"; Philips Res. Rep. 3, 81–101 (1948).

Thus, where every reciprocal linear circuit device can be represented by an appropriate combination of the four basic element types, inductor, capacitor, resistor, and ideal transformer, Tellegen envisioned that by augmenting these with a fifth element type, the gyrator, every non-reciprocal linear device could be represented as well.

The gyrator is a non-dissipative two-terminal device having forward and reverse transfer phases which differ by 180°.

2. C. L. Hogan: "The Microwave Gyrator"; The Bell System Technical Journal, Vol. XXXI, No. 1, 1–31 (January 1952).

This property might seem to violate the reciprocity principle, a consequence of the symmetry properties with respect to time of the fundamental laws of electromagnetism as expressed by Maxwell's equations, which state that if a voltage is introduced at a first location in a network, and a current is measured at a second location, then the voltage/current ratio will be the same if the locations of the voltage source and current sensor are interchanged.

In fact, the gyrator represents no violation of this general principle at all, but is instead a manifestation, under appropriate conditions, of the distinctive constitutive properties of certain media of electromagnetic propagation, called gyrotropic, which are capable of undergoing a change in their influence on propagating electromagnetic waves under reversal of their state of magnetization. Magnetized ferrites and related magnetic oxides such as YIG (yttrium-iron garnet), magnetoplumbites, and gaseous and solid-state plasmas are examples of gyrotropic materials. Thus, the conventional term "nonreciprocal" should not be taken literally, but only as a convenient designation for this class of phenomena. This property is exhibited with particular clarity in the phenomenon of magnetic resonance induction:

3. F. Bloch, W. W. Hansen & M. Packard: "The Nuclear Induction Experiment"; Phys. Rev. 70 474 (1946).
4. N. F. Ramsey, *Nuclear Moments*; Wiley, 1953.

and in microwave Faraday rotation of the polarization:

5. C. L. Hogan, "The Ferromagnetic Faraday Effect at Microwave Frequencies and its Applications" Rev. Mod. Phys., Vol 25, pg 253 (1953).
6. B. Lax & K. J. Button, *Microwave Ferrites and Ferrimagnetics*; McGraw-Hill, Sec. 12-1, p. 544 (1962).

The Bloch and Ramsey references [3,4 ]illustrate magnetic resonance induction at radio frequencies. In these examples, a sphere or other small specimen of gyrotropic material is placed at the center of two mutually orthogonal concentric wire loops or coils mounted in an electromagnet. When excited by an applied radio-frequency signal in one of the coils, the magnetic moment of the specimen is set into precessional motion, inducing an output signal in the other coil. The sense of precession, clockwise or counterclockwise, in response to an oscillating signal is related to the direction of the static magnetizing field. If the static field is reversed, the direction of magnetization and the sense of precession reverse. This, in turn, reverses the phase of the electromagnetic coupling. Likewise, if the roles of input and output connections are interchanged, the direction of the magnetic field being left unchanged, the phase relation between the incident and output signal is reversed. This is the physical basis for the gyrator action.

The principle is the same in the case of the Hogan and Lax & Button references [5,6], which illustrate microwave Faraday rotation. In these examples, a rod of gyrotropic material is mounted on the axis of a circular-cylindrical waveguide and magnetized axially. An incident linearly polarized microwave signal undergoes rotation of its plane of polarization due to interaction with the precessional magnetic motion which the signal induces in the rod. Here again, the sense of polarization rotation is determined by that of the precession which, in turn, depends on the direction of magnetization. To demonstrate the performance of the microwave gyrator, single-mode waveguides connected at the input and output ends of the cylindrical guide are oriented about their axes as polarizer and analyzer to accept polarizations at 90° relative to one another. Similarly, conditions in the rotator section, principally the diameter and composition of the rod, and magnitude of the applied static magnetic field, are arranged to produce a Faraday rotation angle of 90°. Thus, a signal incident from either end undergoes Faraday rotation so as to be suitably polarized for transmission at the other end with only incidental scattering, but the phase of the transmission is opposite (differing by 180°) in the case of the two directions. Likewise, the phase changes for transmission in the two directions are interchanged if the direction of magnetization is reversed. These are the essential characteristics of the gyrator.

The gyrator has long been a focal point of interest in relation to microwave device and system technology, for its practical utility as well as for its theoretical significance. Gyrators have served as the basic nonreciprocal element in circulators and isolators, which are indispensable in microwave systems of all kinds as means to divide, combine and direct signals and to suppress unwanted reflections in microwave systems. Actual physical embodiments of the gyrator can perform as the non-reciprocal element in many magnetic microwave devices; in addition, the gyrator also serves as a powerful abstract concept for logical representation and analysis in microwave circuit theory. Gyrators are also incorporated into devices which provide other essential circuit functions, such as magnetically controlled switching and phase shifting operations.

Prior Art FIG. 1 illustrates a gyrator employed in a four-port circulator which can function as a signal director, divider or combiner or as an isolator or switch. The circuit is a bridge configuration consisting of two "hybrid" or "magic" T junctions, T1 and T2, connected by two parallel lengths of transmission line 22A, 22B. Each junction T1, T2 includes an even symmetry port (circulator ports 1 and 2) and an odd symmetry port (circulator ports 3 and 4). Consider first an incident signal entering the circulator via port 1. The incident signal 20 is divided into two parts 20A, 20B which are conducted on two lines, or arms, of the bridge 22A, 22B. In junction T2, the two signals 20A, 20B are recombined into signal 24. A gyrator G is positioned in the first arm 22A. The lengths of the two arms 22A, 22B are designed such that, for an incident signal entering port 1, the even-symmetry port of T1, and propagating in the direction from T1 to T2, the two signals 20A, 20B remain in phase and are combined to emerge 24 at the even-symmetry port of T2 (circulator port 2).

Consider now a second signal 26 incident on port 2 traversing through the circuit in the opposite direction from junction T2 to T1. Since the gyrator G furnishes a 180° difference in phase for this signal compared with the first direction of propagation, it follows that, for a signal 26 incident at port 2 and divided with equal phase into signals 26A, 26B, the two signals 26A, 26B arrive at T1 precisely out of phase and are combined into signal 28 at the odd-symmetry port (circulator port 3) of T1 . This illustrates the essential circulator action. Continuing the same logic, a signal 30 incident at port 3 of T1 is divided with an initial 180° phase difference at junction T1 due to the odd symmetry at that port and emerges at the odd-symmetry port of T2 (circulator port 4) as signal 32. Likewise, a signal 34 incident on port 4 and divided with an initial 180° phase difference at T2 is affected by a further 180° phase change due to the gyrator G and emerges at the even-symmetry port of T1 (circulator port 1) as signal 36.

The device described in the above example can be adapted for use as an isolator by designating three ports of each T-junction for the signal path, with the remaining port of each T-junction terminated with matched attenuators. This circuit can also serve as a switch or reversible circulator, by taking advantage of the magnetic-control feature intrinsic to the gyrator: if the direction of magnetization of the gyrotropic element is reversed, the gyrator action is reversed and the 180° phase difference between the two arms of the bridge occurs for propagation in the opposite direction, from T1 and T2, thereby reversing the circulation port sequence outlined above, from 1-2-3-4-1 . . . to 1-4-3-2-1 . . . .

Modern implementations of the gyrator generally require a complicated structure, including a magnetic yoke external to the microwave path, which makes them comparatively large in size and weight and expensive to manufacture. For these reasons, modern gyrators do not lend themselves well to the evolving technology of microwave planar circuits, where minimization of size, weight, and cost are essential.

SUMMARY OF THE INVENTION

The present invention is directed to an apparatus and method for forming a gyrator configured in planar circuit technology. The apparatus of the invention comprises first and second parallel transmission lines positioned proximal to a gyrotropic medium or substrate. By virtue of their symmetry, the transmission lines are adapted to propagate normal modes which are even and odd with respect to the central plane of symmetry. Gyromagnetic interaction leads to mixing or coupling of these modes, resulting in elliptically-polarized normal modes of opposite chirality, where chirality signifies right and left handedness. Excitation of a combination of these modes results in Faraday rotation of the polarization, which is most clearly evident in the zone of the magnetized gyrotropic substrate between the two transmission lines. The resultant effect is a conversion of the wave field from one of even to odd symmetry in the course of transmission from input to output.

Input and output transducers couple the ends of the transmission lines to corresponding input and output ports. In an illustrative embodiment, the input transducer transmits waves of even symmetry, while reflecting waves of odd symmetry. The output transducer behaves in an opposite manner. The widths and spacing of the transmission lines can be selected by well-known methods of guided-wave theory and practice to produce optimal impedance match and device frequency bandwidth. Numerical analysis has indicated that the invention exhibits inherent broadband capability.

In one aspect, the invention comprises first and second substantially parallel conductors capable of supporting two normal modes in the form of first and second elliptically polarized wave fields propagating in substantially opposite chirality. A first transducer couples a first port to the first and second conductors such that an electromagnetic wave incident at the first port excites waves on the first and second conductors with substantially equal phase and amplitude (even mode). These waves can be regarded as superposition of the first and second elliptically polarized partial wave fields mentioned above. A gyrotropic medium is positioned sufficiently proximal to the conductors to cause gyromagnetic interaction between the magnetization in the medium and the partial wave fields. The gyromagnetic interaction causes unequal phase change of the first and second partial wave fields during propagation. A second transducer couples the first and second conductors to a second port such that the unequal phases of the partial wave fields arriving at the second transducer are compensated to substantially reinforce at the second port. In this manner, the resultant difference in phase change for a first wave propagating from the first to the second port and a second wave propagating from the second to the first port is substantially an odd-integer multiple of 180 degrees. In other words, the device operates as a gyrator.

In another aspect, the invention comprises a device operating as a gyrator including a gyrotropic substrate in proximity with first and second substantially parallel conductors. The conductors are capable of supporting first and second wave fields of substantially opposite chirality. Each wave field travels on both conductors simultaneously, as described above. The substrate is in sufficient proximity with the conductors to interact gyromagnetically with the wave fields. A first transducer is coupled to first ends of the first and second conductors and a second transducer is coupled to opposite second ends of the conductors. The first transducer is preferably adapted to excite first and second partial wave fields on the conductors, the partial wave fields being of substantially equal phase, when a first electromagnetic wave is incident on the first port. For propagation in the opposite direction, the first transducer produces reinforcement at the first port of first and second wave fields on the conductors of substantially equal phase. The second transducer behaves in an opposite manner. The second transducer is adapted to excite waves on the conductors of substantially opposite phase, when a second electromagnetic wave incident at the second port. For propagation in the opposite direction, the second transducer produces reinforcement at the second port of first and second wave fields on the conductors of substantially opposite phase.

In a preferred embodiment, the input port is divided and conductively connected to both of the two coupled transmission lines in a symmetrical manner at the input transducer so as to excite a wave of even symmetry. The output port, on the other hand, is connected to the transmission lines in an unsymmetrical manner at the output transducer so as to provide the function of a "balun", or balanced-to-unbalanced transducer, which shifts waves of opposite phase on the two coupled lines into equal phase. Thus, they will reinforce, not cancel, when they flow together at the output port. For example, at the output port, one of the transmission lines is connected directly to the output and the other is connected through a half-wavelength "hairpin" extension, bringing the out-of-phase components from the transmission lines into equal phase so as to reinforce, or otherwise interfere constructively at the output. The concept of a balun is well known in transmission-line art and may be realized in various ways for planar applications. Note that the terms "input" and "output" as used herein when referring to ports and transducers are used for the purpose of clarity only and are freely interchangeable.

In a second preferred embodiment, the magnetization is confined within the gyromagnetic structure, such that the structure is magnetized in its plane, parallel to the orientation of the transmission lines. This enhances the design and performance of the planar circuit, lending this embodiment well to the emerging interest in high temperature superconductors. The present invention is operable in a partial or fully magnetized state. Where the gyrotropic medium is formed in a closed path, it can be magnetized by an initial latching current and operated in a remanent state, that is, without an external magnet or coil.

The invention has application as a magnetically-controlled phaser or switch, or as a component in a circulator or isolator implemented in planar microwave technology. The invention is especially attractive to application in miniaturized planar microwave devices, for example MMICs.

BRIEF DESCRIPTION OF THE DRAWINGS

The foregoing and other objects, features and advantages of the invention will be apparent from the more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF PREFERRED EMBODIMENTS

Figure 1:
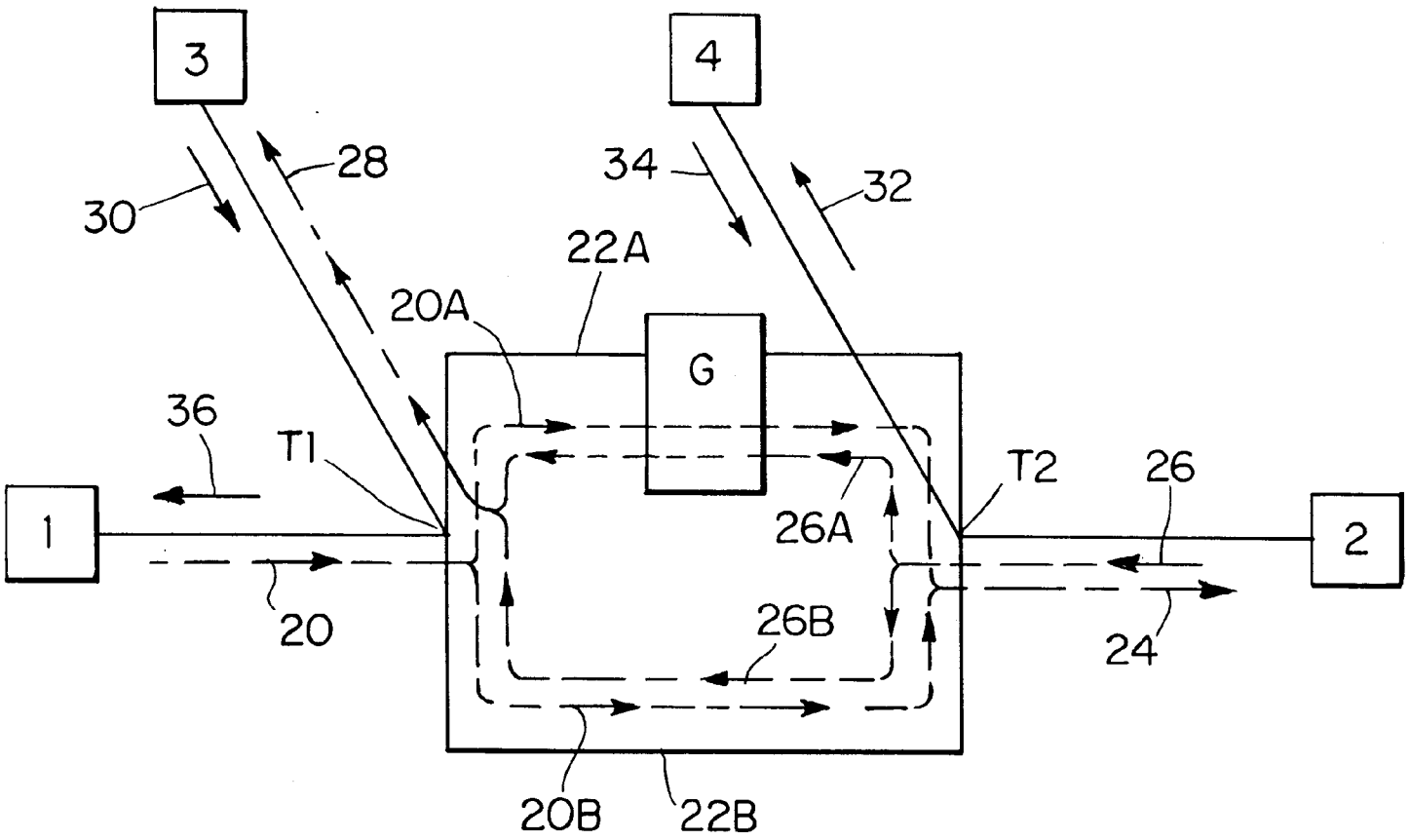
FIG. 1 PRIOR ART
FIG. 1 is a schemtic illustration of a prior-art four-port circulator employing a gyrator.
Figures 2, 3:
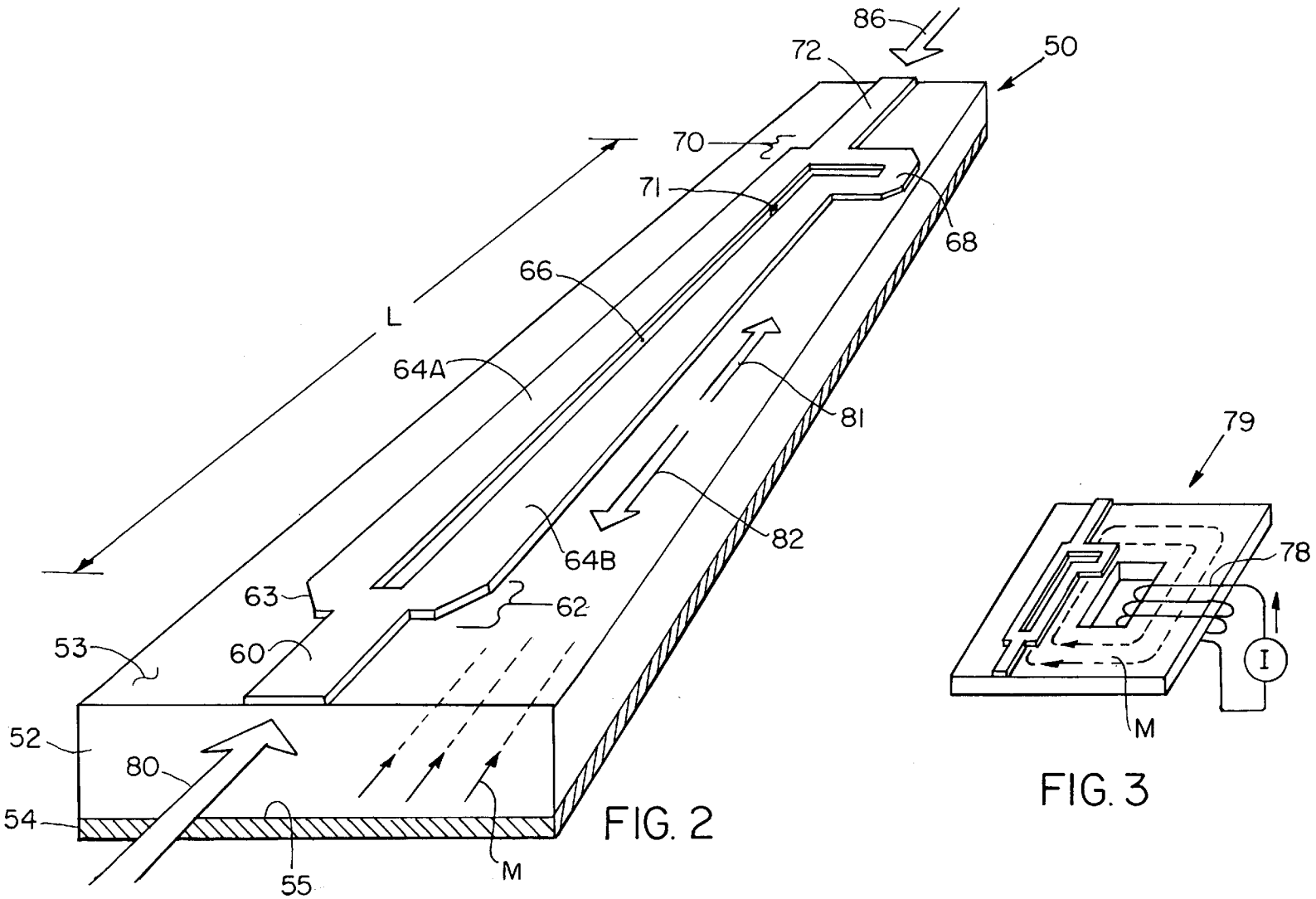
FIG. 2 is a perspective view of an illustrative embodiment of a planar gyrator in accordance with the present invention.
FIG. 3 is a perspective view of a gyrator implemented on a substrate in the form of a closed magnetic circuit magnetized within its plane in accordance with the present invention.

With reference to FIG. 2, the gyrator 50 hereafter described in detail is referred to as a planar-circuit gyrator, or planar gyrator. In a preferred embodiment, the planar gyrator 50 comprises a coupled pair of substantially parallel transmission lines 64A, 64B of preferably equal width in sufficient proximity with a gyrotropic medium 52 so as to interact gyromagnetically therewith. The transmission lines 64A, 64B are coupled to a first port 60 at a first end and a second port 72 at a second end by first and second transducers 62, 70 respectively.

The gyrotropic medium 52 preferably comprises a ferrite substrate magnetized in its plane, that is, having a magnetization M parallel to the direction of the transmission lines 64A, 64B as shown in FIGS. 2 and 3. The transmission lines 64A, 64B comprise two parallel conducting strips of equal width, for example microstrip or balanced stripline, deposited on a first surface 53 of the substrate 52. An opposite surface 55 of the substrate 52 is coated with a ground plane 54. The strips 64A, 64B are preferably chamfered 63 at the corners to reduce unwanted or spurious reflections.

The coupling length L between the transmission lines 64A, 64B is preferably approximately equal to one-half wavelength, in terms of the average of the even- and odd-mode propagation constants, at the center of the frequency range contemplated for the design. The widths and spacing of the coupled strips can be selected to yield favorable performance in terms of match and bandwidth.

Figure 4A:
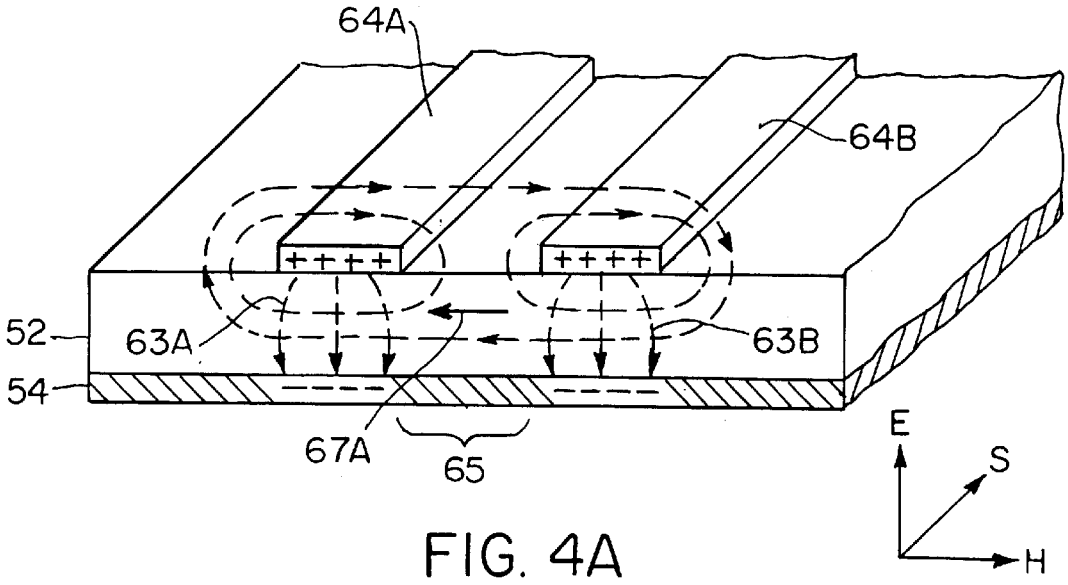
FIGS. 4A and 4B are perspective sectional views of the electric and magnetic field configurations of even and odd modes of propagation respectively.
Figure 4B:
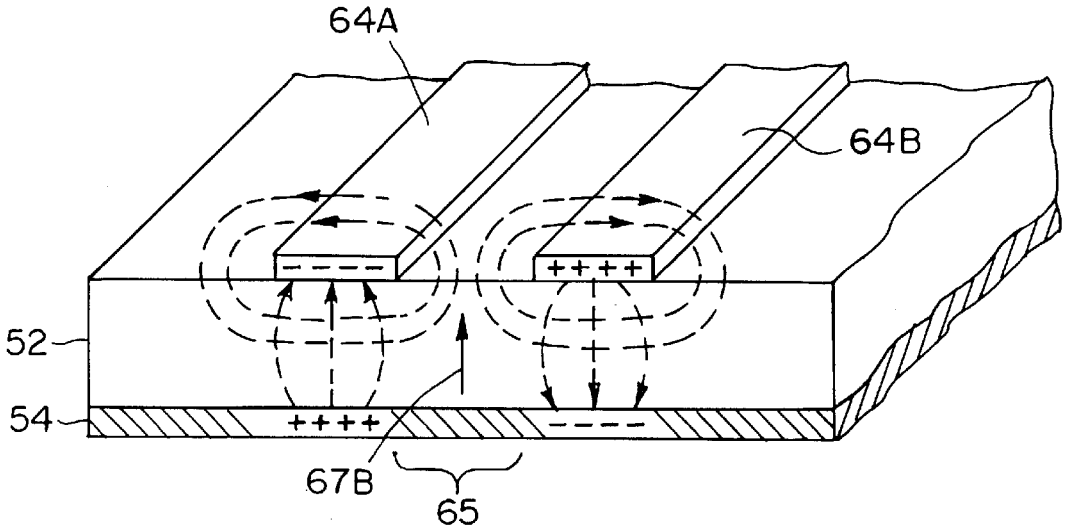

The conceptual resemblance between this arrangement and the waveguide Faraday rotator cited above may be seen by considering the polarization of the field in the magnetic medium in the vicinity of the gap 66 between the transmission lines 64A, 64B. Referring to FIG. 4, note that in the case of the even mode, FIG. 4A, in the zone 65 between and beneath the two transmission lines 64A, 64B, with electric fields 63A, 63B oriented as shown, the resultant microwave magnetic field 67A is predominantly directed horizontally; in that same region, in the case of the odd mode, FIG. 4B, it is predominantly vertical 67B. Superposition of the two modes with equal phase would result in a diagonal direction of polarization in the zone 65; but when the two are superposed with a 90 degree relative shift in phase, as occurs as a result of gyromagnetic interaction, the result is an elliptical polarization with the direction of the field at a given location rotating as the wave propagates. In that zone 65, the microwave field is comparable to that near the center of the circularly cylindrical waveguide as contemplated in the case of waveguide Faraday rotation devices.

The gyromagnetic interaction is a stimulation by the propagating microwave magnetic field of the atomic magnetic moments which are responsible for the magnetic properties of the substrate material. The response is a gyroscope-like precessional motion of the moments with a clockwise, or right-handed, sense (chirality) relative to the direction of magnetization of the substrate. This right-handed sense is dictated by a fundamental relation between the intrinsic angular momentum and magnetic moment of the atomic electrons. A wave which is circularly polarized in the sense synchronous with the precessional motion interacts strongly with the medium and normally undergoes retardation of its velocity of propagation, while a wave circularly polarized in opposition to the precession interacts only weakly, and its velocity is normally affected to a lesser degree. The phenomenon is most striking under conditions of magnetic resonance, but those conditions are not necessarily the most favorable for device performance.

A preferred magnetic state of the substrate is that based on the property of hysteresis, whereby the medium remains magnetized after an internal magnetic field furnished by means of an externally imposed solenoid or electromagnet has been applied and then removed. This condition is represented by the direction and magnitude of the magnetization, or magnetic moment density M of the gyrotropic medium. The value of this parameter required for successful gyrator function is customarily expressed by the ratio $\kappa/\mu$, where $\mu$ and $\kappa$ denote respectively the diagonal and off-diagonal components of the gyromagnetic permeability tensor customarily known as the Polder tensor:

7. D. Polder, "On the Theory of Ferromagnetic Resonance", Phil Mag, Vol. 40, pg. 99 (1949)

Under preferred conditions of operation, with the medium in its remanent state and with a static internal magnetic field which is very small or altogether absent, this ratio is approximately equal to $f_M/f$, where $f_M$ is proportional to M [$f_M=\gamma(4\pi M)$, where $\gamma$ is the gyromagnetic constant] and f is the frequency of the microwave signal.

The preferred direction of magnetization is within the plane of the planar-circuit substrate and aligned parallel to the direction of propagation of the coupled transmission lines. The magnitude of $f_M/f$ must be great enough to produce full transmission through the device; i.e., full conversion of the incoming wave of even symmetry into the outgoing wave of odd symmetry, with minimum reflection of the incident wave. The magnitude of $f_M/f$ must be less than unity, $f_M/f<1$, however, in order to avoid the onset of a magnetic-resonance-related energy dissipation effect, known as low-field loss, to which magnetic media are susceptible when less than fully magnetized.

The selection of material of suitable chemical and crystallographic composition in order to meet the above requirements can be accomplished by methods and principles which are well known to those versed in magnetic microwave technology.

Referring back to FIG. 2, the transmission lines 64A, 64B are terminated at each end by first and second transducers 62, 70 which couple the transmission lines 64A, 64B to first and second ports 60, 72. In a preferred embodiment, the first transducer 62 transmits the even mode of a signal 82 within the coupled line region propagating toward the first transducer 62 with substantially no dissipative loss or reflection, while blocking the odd mode with substantially complete reflection and negligible dissipation. The second transducer 70 at the opposite end behaves in an opposite manner, transmitting the odd mode and blocking the even mode of signal 81. Similarly, a first electromagnetic input wave 80 arriving at the first port 60 excites first and second normal mode partial wave fields on the conductors 64A, 64B with substantially equal phase and amplitude, while a second electromagnetic input wave 86 arriving at the second port 72 excites the partial wave fields with substantially opposite phase.

The principle of the planar gyrator 50 does not depend on ideal fulfillment of these scattering requirements at the transducers. The existence of a sufficient distinction between the even- and odd-mode scattering amplitudes will suffice. Device performance is related to the degree of this distinction. Analysis of the planar gyrator performance takes into consideration the scattering of the incident wave and of counterpropagating internal waves 81, 82 at the transducers 62, 70 together with propagation of the normal modes along the length of the coupled transmission lines 64A, 64B.

A preferred embodiment of the planar gyrator includes a planar circuit as described above, with the magnetized substrate 52 comprising one leg of a closed planar magnetic circuit 79 capable of remaining permanently magnetized or "latched" in its remanent state as shown in FIG. 3. An optional current winding 78 serves to reverse the sense of magnetization, if such switching capability is called for in the application.

Figure 5A:
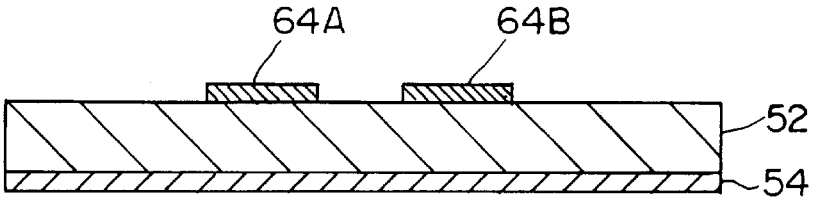
FIGS. 5A, 5B, 5C, and 5D illustrate a planar gyrator having a single layer of gyrotropic material, dual layers of gyrotropic material, dual layers each with ground planes, and with conductors embedded in the gyrotropic material respectively in accordance with the present invention.

FIGS. 5A–5D illustrate cross-sectional views of alternative planar technologies. FIG. 5A illustrates a planar gyrator having a single gyrotropic substrate 52, coupled conducting transmission line strips 64A, 64B, and a ground plane 54.

Figure 5B:
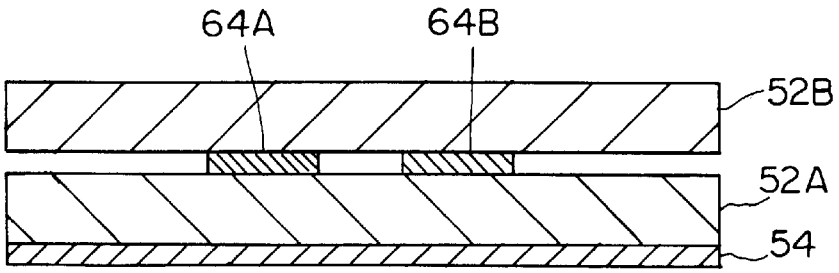

In FIG. 5B, a second gyrotropic layer 52B, magnetized in a direction opposite the first layer 52A, is applied to upper surface of the circuit 64A, 64B. Such a configuration confers several significant advantages. First, it mitigates the disadvantageous effects of an inhomogeneous dielectric cross-section giving rise to unequal propagation constants for the even and odd modes, which tends to degrade the gyrator performance. Second, both the upper 52B and lower 52A gyrotropic layers contribute to the nonreciprocal gyrator action, increasing the gyrotropic effect by at least a factor of two. Third, in this configuration the layers could be arranged to form the forward and return legs of the same magnetic circuit, leading to a very efficient high remanent state with low-energy and high-speed switching. If this dual gyrotropic layer arrangement is incompatible with the magnetic circuit requirements or other constraints of the application in question, a dielectric overlay applied to the upper surface having a dielectric constant similar to that of the ferrite substrate would still confer the first advantage mentioned above.

Figure 5C:
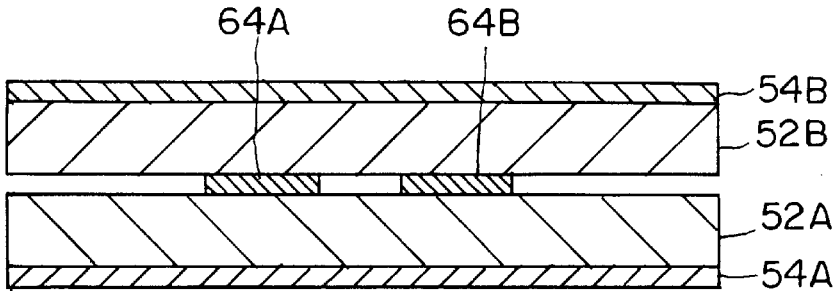
Figure 5D:
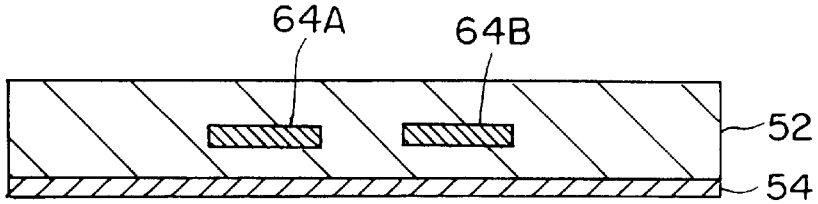

The embodiment of FIG. 5C adds a second ground layer 54B to the upper layer of gyrotropic material 52B. The resulting balanced stripline configuration confers additional confinement and shielding of the device and would be expected to lead to optimum strength of the gyromagnetic interaction. In FIG. 5D, the conductors 64A, 64B are embedded in the gyrotropic material 52.

Design considerations of the first and second dual-mode transducers 62, 70 will now be described in further detail. Selective coupling of the incoming signal 80 to the even mode is relatively easily accomplished, for example, by a symmetrical division of the input port 60 to form the coupled transmission line pair 64A, 64B as shown in FIG. 2. Such a simple configuration intrinsically represents a short circuit to the odd mode (since it joins together points of positive and negative polarity of that mode) while lending the capability of providing a favorable match for excitation of the even mode. Local fringing reactance giving rise to a minor mismatch can be compensated by capacitive or inductive steps as generally practiced in the well-known filter and coupler arts and as described in the following references, incorporated herein by reference:

8. Brian C. Wadell, *Transmission-Line Design Handbook*; Artech House, 1991.
9. K. C. Gupta, R. Garg & I. J. Bahl, *Microstrip Lines and Slotlines*; Artech House, 1979.
10. G. Matthaei, L. Young & E. M. T. Jones, *Microwave Filters Impedance-Matching Networks, and Coupling Structures*; McGraw-Hill, 1964. Reprint: Artech House, 1980.

Figure 6A:
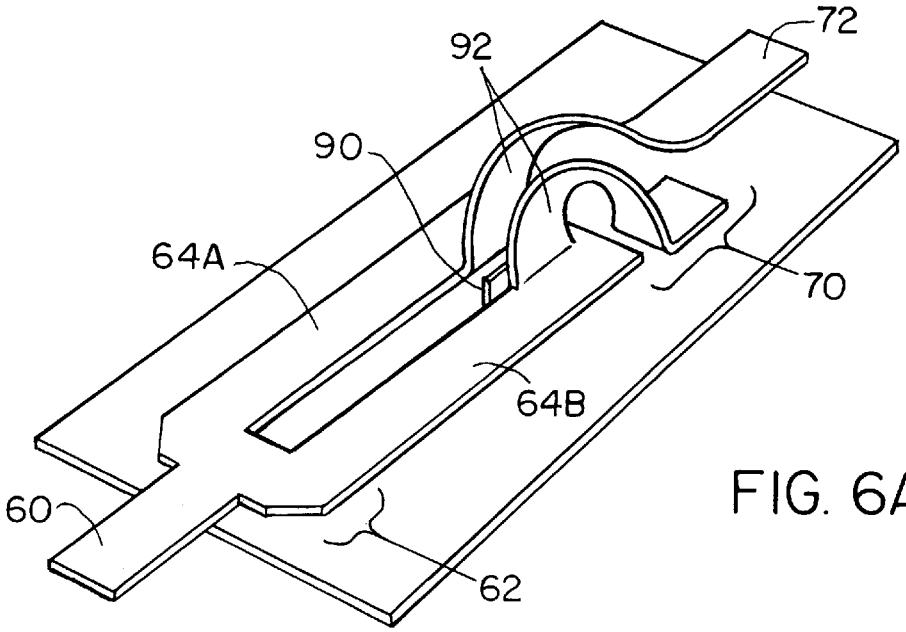
FIG. 6A and 6B are perspective illustrations of alternative balun embodiments in accordance with the present invention.
Figure 6B:
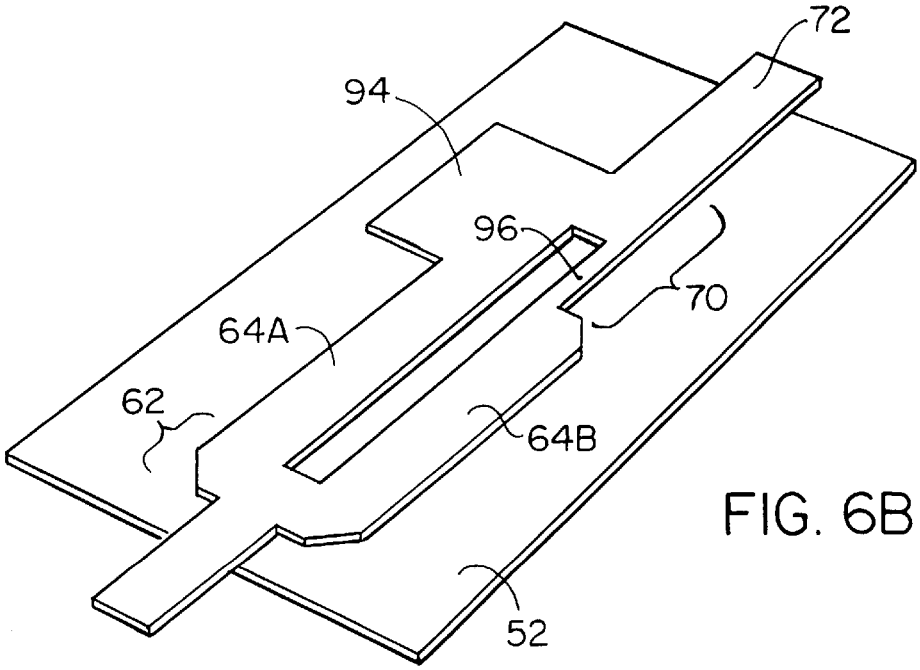

Design of the odd-mode transducer 70 at the output end presents additional challenges. A short circuit for the even mode at that end can be created, for example, by inserting a grounded vertical pin 71 or vane symmetrically disposed between the two transmission lines 64A, 64B in the vicinity of the odd-mode transducer. An unsymmetrical element constituting a "balun" brings the component signals of opposite polarity from the two coupled lines into equal phase at the output port 72. This has the effect of coupling the odd mode to the output port 72, and, with appropriate matching features as generally practiced, prevents or minimizes reflection of the odd mode back into the transmission lines 64A, 64B. In the examples shown in FIGS. 2 and 3, the balun takes the form of a "hairpin" 68 of total length one-half wavelength inserted into one of the lines 64B. In addition to the hairpin example, two alternative embodiments of the balun principle are shown in FIGS. 6A and 6B. In FIG. 6A, a strip structure 92, electrically analogous to an E-plane port in rectangular-tube waveguide, couples waves of the odd mode on the two coupled strips 64A, 64B into a single-conductor planar line 72. A central vane 90 or pin 71 (see FIG. 2) provides a short-circuit reflector for the even mode. In FIG. 6B, structures 94, 96 constituting "lumped elements", a capacitor 94 on conductor 64A and an inductor 96 on conductor 64B, provide phase discontinuities of approximately −90 degrees and +90 degrees, respectively, at the output port 72, adding to give the total of approximately 180 degrees required in order to produce substantial constructive interference at the output line 72 for the odd mode and substantial destructive interference for the even mode. Each of these, as well as other possible designs, presents its own tradeoffs between advantages and disadvantages whose suitability depends on the specific application in question.

Figure 7:
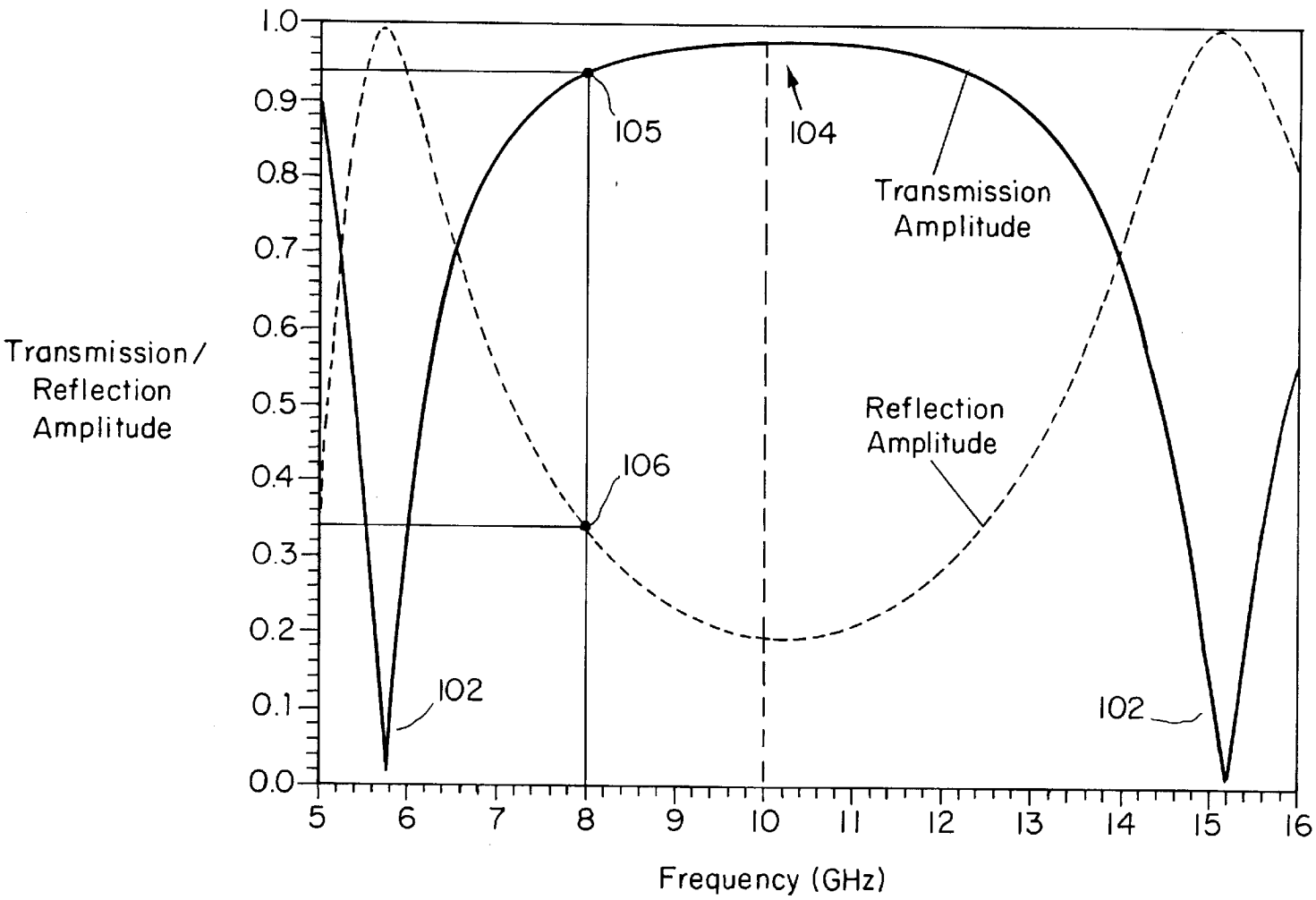
FIG. 7 is a chart of computed transmission and reflection amplitudes of a simplified computational model of the planar gyrator with a designed band center at 10 GHz in accordance with the present invention.

Results of a computational analysis are illustrated in FIGS. 7–9. FIG. 7 is a chart of transmission and reflection amplitudes as functions of frequency for a computational model of the planar gyrator having a band center near 10 GHz, assuming a homogeneous medium. Illustrative points 105, 106 at a frequency of 8 GHz are indicated for comparison in FIGS. 7–9. Sharp nulls 102 are apparent in transmission at frequencies at which the length L of the coupled transmission line section is approximately equal to an odd-integer multiple of a quarter-wavelength. At frequencies between these features, i.e., over ranges centered at integer multiples of a half-wavelength, there is generally a broad region 104 of relatively low reflection, at least part of which may present an excellent match. These matching regions are the favorable operating ranges of the device. Except at the narrow nulls 102 mentioned, the device exhibits classic gyrator performance; namely, 180° phase differential between the two directions of propagation and 180° reversal of the transmission phase in either direction upon reversal of the direction of magnetization.

Figure 8A:
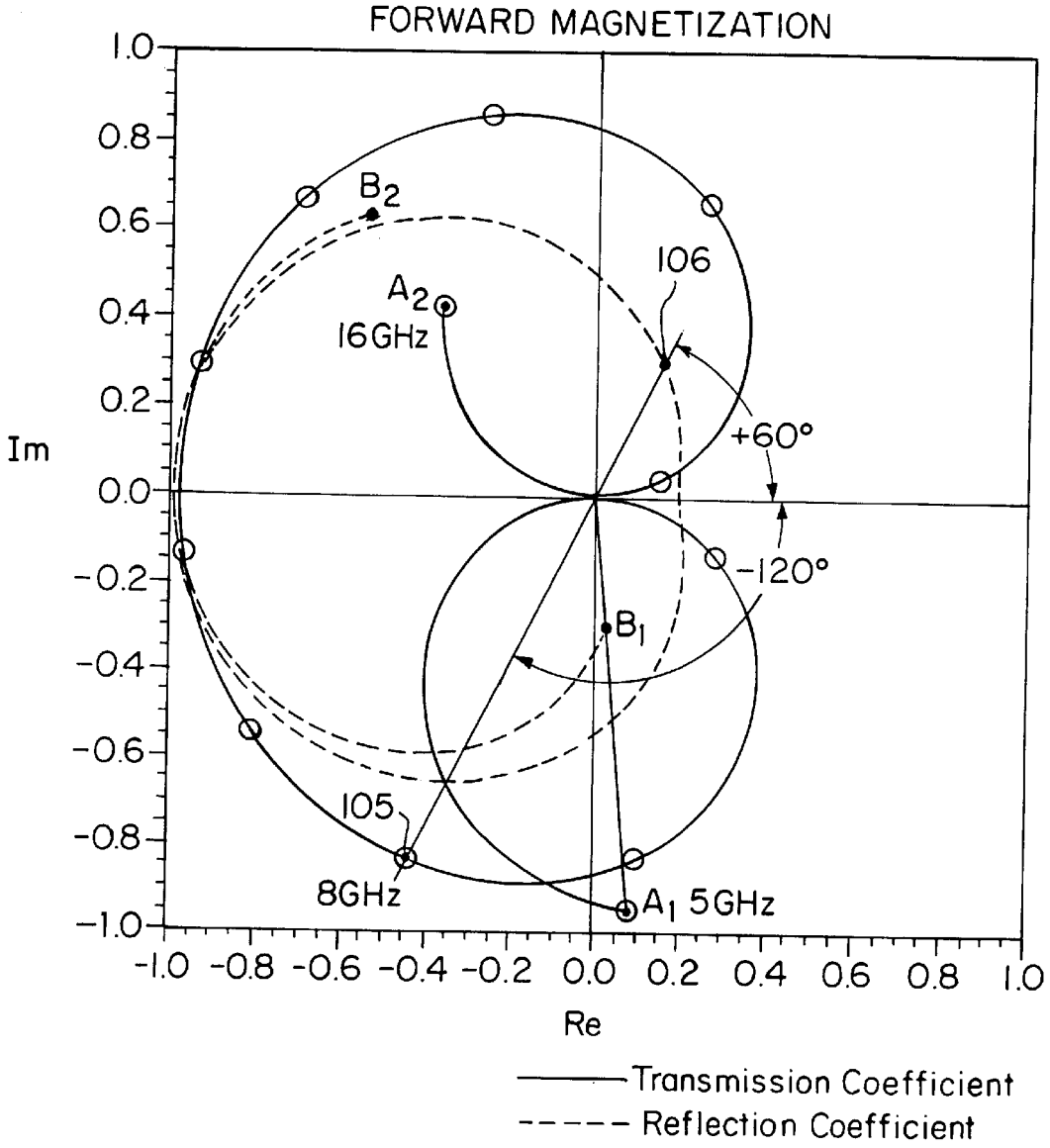
FIG. 8A and 8B are charts of the transmission and reflection coefficients of the planar gyrator on the plane of complex numbers for forward and reverse magnetizations illustrating gyrator action in accordance with the present invention.

FIG. 8A is a chart of the phase and amplitude of the transmission coefficient A1 . . . A2 and reflection coefficient B1 . . . B2 over an operating range of 5 to 16 GHz, represented on the plane of complex numbers. FIG. 8A refers to the case of magnetization of the substrate in the positive direction. Thus, for example, the radial line representing a transmission phase angle of substantially −120 degrees intersects curve A at a point 105 whose radial position indicates a transmission coefficient amplitude of 0.98; and the radial line representing a phase angle of substantially +60 degrees intersects curve B at a point 106 indicating a reflection coefficient amplitude of 0.33. The corresponding points in FIG. 7 show that these values occur at a frequency of 8.0 GHz.

Figure 8B:
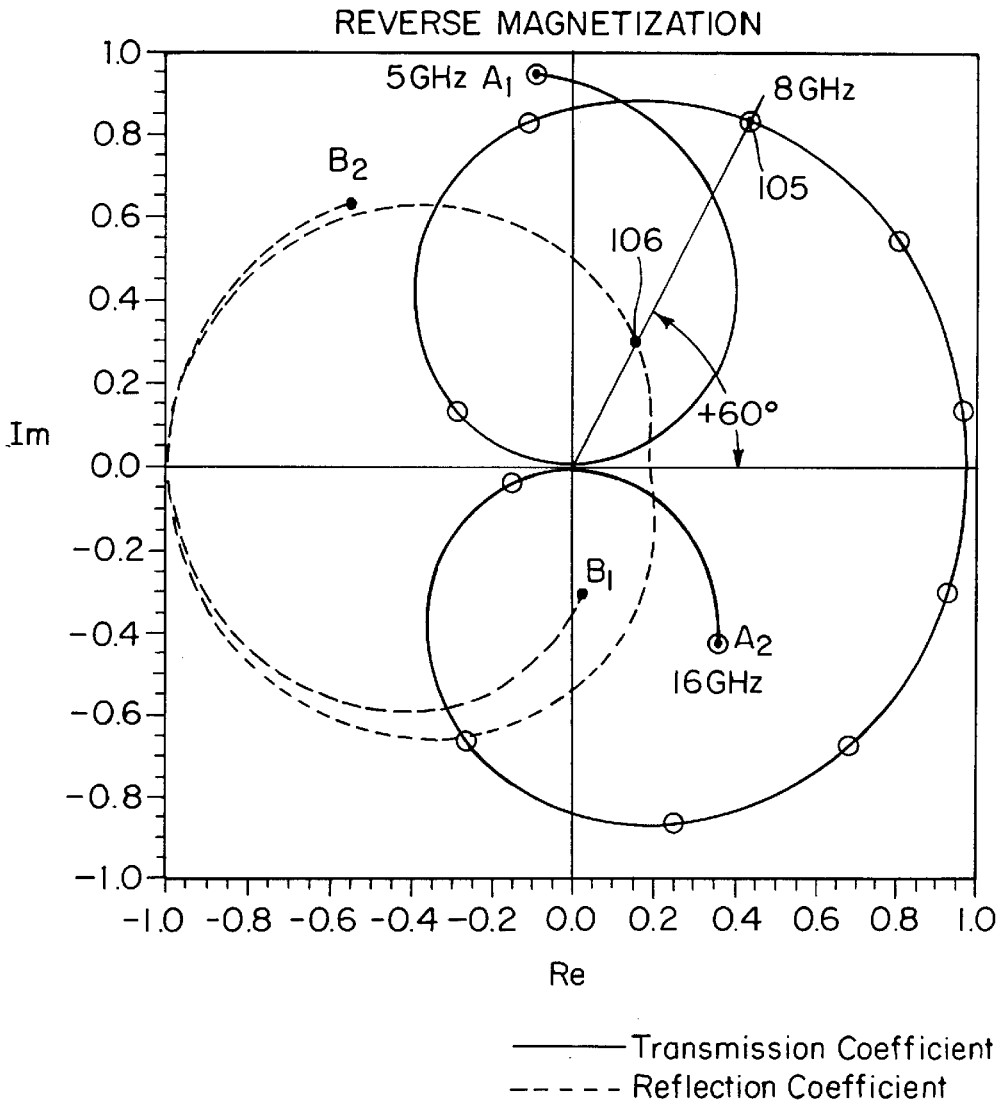

In FIG. 8B, the transmission coefficient A1 . . . A2 and reflection coefficient B1 . . . B2 are illustrated with magnetization reversed from that of FIG. 8A. The phase of the reflection coefficient B1 . . . B2 remains unchanged, as expected. On the other hand, curve A1 . . . A2 is turned over such as to indicate that the phase of the transmission coefficient is shifted by 180 degrees at every frequency, illustrating classic gyrator action. This same result is obtained if the magnetization is left unchanged and identities of the input and output ports are interchanged.

Figure 9A:
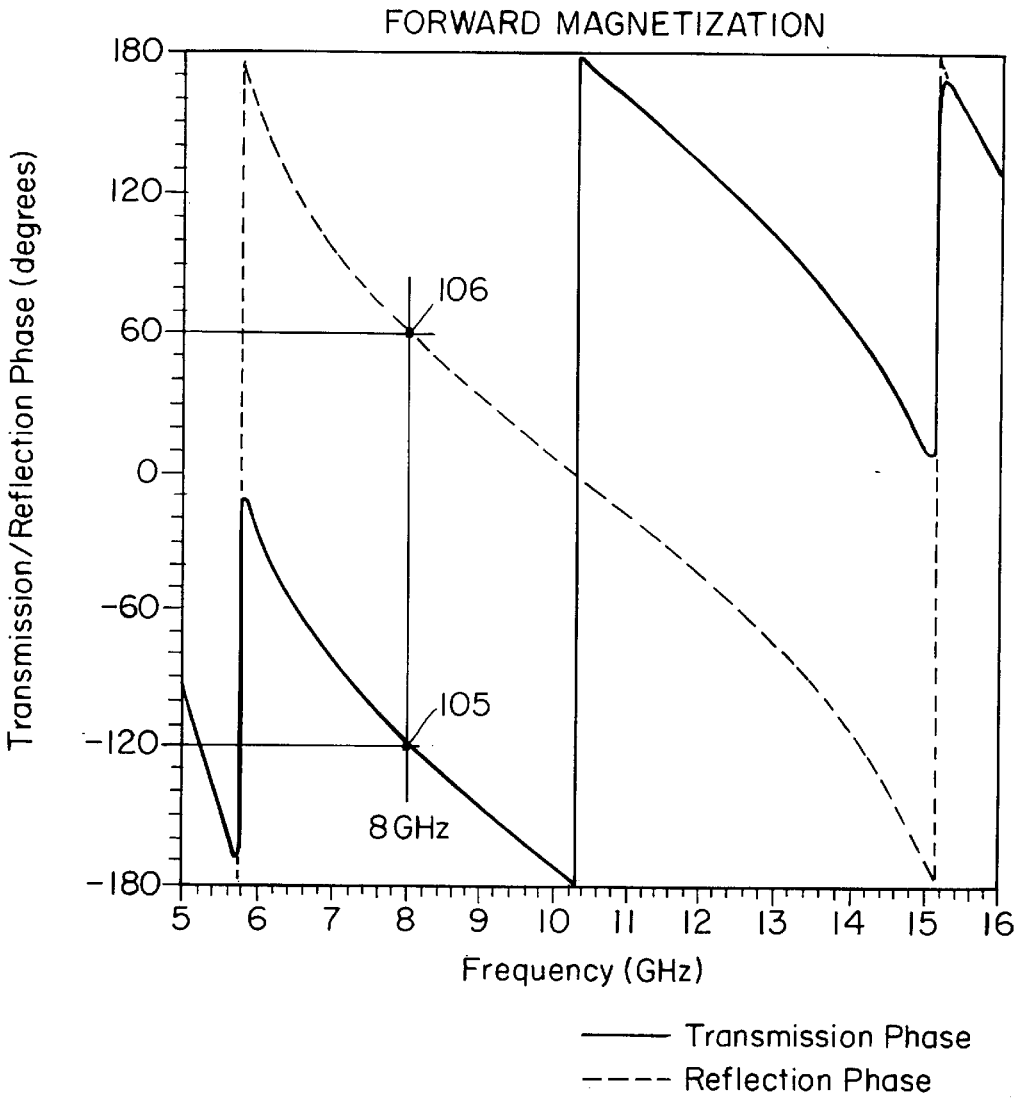
FIGS. 9A and 9B are charts of the transmission and reflection phases as functions of frequency for forward and reverse magnetizations respectively, illustrating classic gyrator action in accordance with the present invention.
Figure 9B:
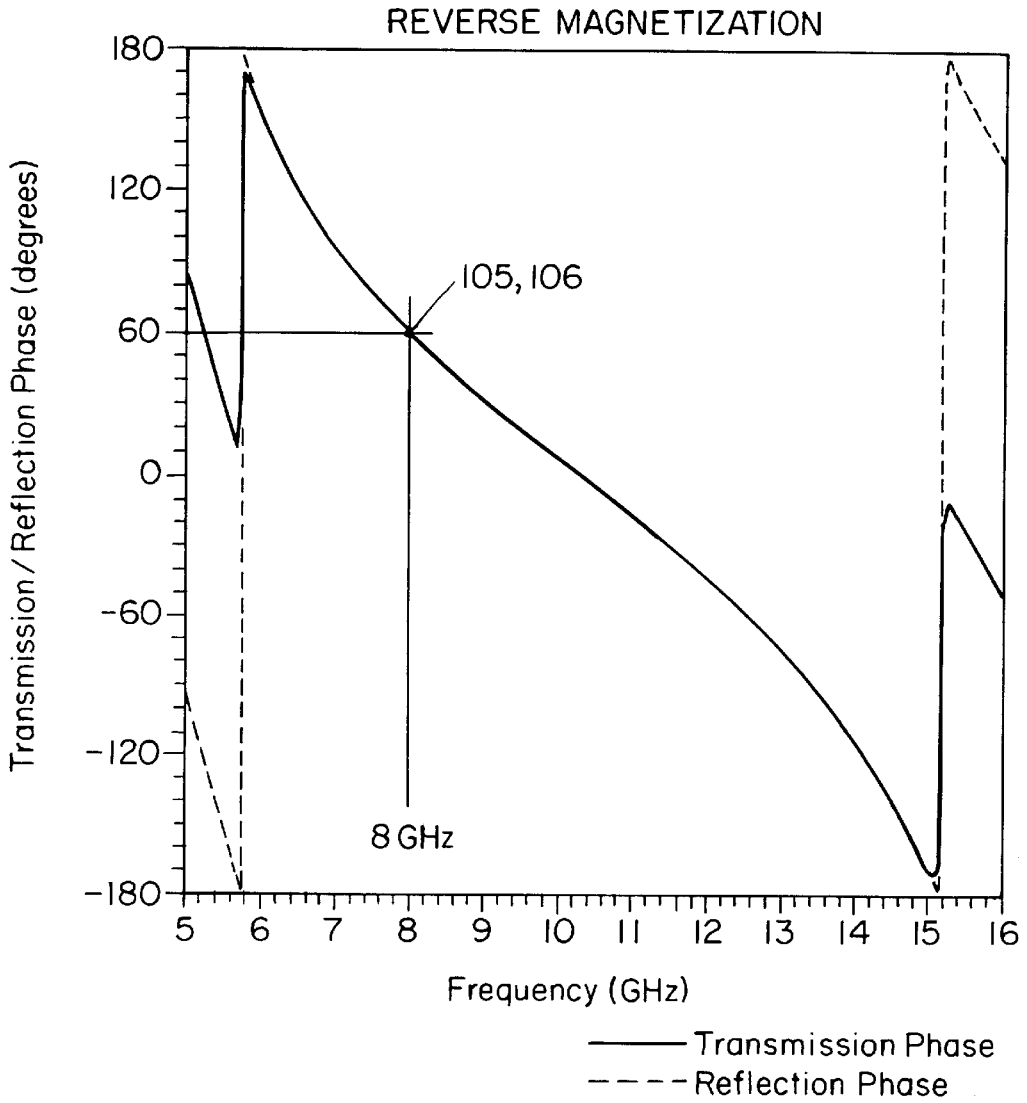

FIGS. 9A and 9B are charts of the phase angle as in FIGS. 8A and 8B respectively, plotted versus frequency. The point 105 in FIG. 9A at 8.0 GHz, indicating a transmission phase value of −120 degrees, corresponds to the point 105 in FIG. 8A cited above. In FIG. 9B, the magnetization is reversed and, comparing FIGS. 8A and 8B, 180 degree transmission phase change between positive and negative magnetizations is evident, illustrating gyrator action. The illustrative point 105 at 8.0 GHz has changed from a phase of −120 degrees to a phase of 60 degrees.

Within the above general sketch of the concept of a planar gyrator, considerable flexibility exists for optimization and adaptation to specific frequency bands, geometrical constraints and system objectives by means well known to those skilled in the art.

The present invention is further applicable for use as a magnetically-controlled switch, since in the unmagnetized state the input port and output port may be made highly uncoupled over a broad band. For the "off" state of the switch, the substrate is demagnetized. In the absence of gyromagnetic coupling, the entering even mode undergoes no conversion to an admixture with the odd mode, and is therefore totally reflected at the output transducer. When the medium is switched to an appropriate state of magnetization, transmission occurs over a substantially broad band, as has been shown above in FIG. 7 and the associated description.

Although the use of circular polarization in planar coupled lines was understood in the past with regard to the meanderline phase shifter for example:

11. Fred J. Rosenbaum, "Integrated Ferrimagnetic Devices", *Advances in Microwaves*, Vol. 8, pp 203–294, Academic Press, 1974;
12. G. T. Roome & H. A. Hair, "Thin Ferrite Devices for Microwave Integrated Circuits", IEEE Trans. MTT, Vol 16, pp 411–420 (1968);

the present invention recognizes that a gyrator can be formed by means of a different configuration; namely parallel planar coupled lines in combination with even and odd mode transducers at the ends of the lines.

There is a tendency for current to be concentrated at the sharp edges of a conductor, leading to undesirable ohmic conductive energy loss. This phenomenon is a problem in a typical photolithographically deposited planar-circuit strip which generally has not only more or less sharp, but furthermore ragged or uneven edges resulting from the etching process. One technique for avoiding this problem is to employ high- or low-temperature superconducting technology, as described in U.S. Pat. No. 5,484,765, incorporated herein by reference. In another technique, the strip conductors are formed to be generally elliptical in cross-section so as to create a smooth, rounded profile, and placed on or embedded in the substrate. The rounded corners of the conductor result in reduced current concentration and thereby reduced loss. The use of gold or other conventional (i.e., non-superconducting) rounded-profile conductors in combination with cryogenic temperatures is still another effective means for reducing conduction loss in planar circuit devices. Note that for purposes of the present disclosure, the term "planar", when referring to conductors, includes and is not limited to the following conductors:

standard photolithographically deposited planar conductors; planar conductors of elliptical cross-section; and planar superconductors.

While this invention has been particularly shown and described with references to preferred embodiments thereof, it will be understood by those skilled in the art that various changes in form and details may be made therein without departing from the spirit and scope of the invention as defined by the appended claims.

I claim:

1. An electromagnetic device comprising:

first and second substantially parallel conductors for supporting first and second elliptically polarized normal-mode wave fields propagating in substantially opposite chirality;

a first transducer coupling a first port to the first and second conductors such that an electromagnetic wave incident at the first port excites first and second normal-mode partial wave fields on the conductors with substantially equal amplitude;

a gyrotropic medium sufficiently proximal to the conductors to introduce gyromagnetic interaction with the wave fields, said gyromagnetic interaction causing unequal phase change of the first and second partial wave fields during propagation; and a second transducer coupling the first and second conductors to a second port, such that the unequal phases of the partial wave fields arriving at the second transducer are compensated so as to constructively interfere at the second port, the resultant difference in phase change on transmission for a first wave propagating from the first to the second port and a second wave propagating from the second to the first port being substantially an odd-integer multiple of 180 degrees.

2. The device of claim 1 wherein the first transducer couples the first port to the conductors such that said electromagnetic wave incident at said first port excites said first and second partial wave fields on the conductors with a predetermined first difference in phase.

3. The device of claim 1 wherein the first transducer couples the first port to the conductors such that said electromagnetic wave incident at said first port excites said first and second partial wave fields on the conductors with substantially equal phase.

4. The device of claim 1 wherein the second transducer couples the second port to the conductors such that a second electromagnetic wave incident at said second port excites said first and second partial wave fields on the conductors with a predetermined second difference in phase.

5. The device of claim 1 wherein the first and second parallel conductors are superconductors operating in a superconducting state.

6. The device of claim 1 wherein the conductors are planar conductors.

7. The device of claim 6 wherein the conductors are photolithographically deposited on a surface of the gyrotropic medium.

8. The device of claim 1 wherein the conductors are shaped to reduce conduction loss.

9. The device of claim 1 wherein the gyrotropic medium includes a state of magnetization which is reversible in direction to cause the unequal phase changes of the first and second partial wave fields to be interchanged, resulting in a reversal of direction of gyrator action.

10. The device of claim 1 wherein the gyrotropic medium includes a state of magnetization which is variable between forward and reverse saturation levels.

11. The device of claim 1 wherein the second transducer includes a balun structure for compensating for unequal phase changes in the first and second partial wave fields.

12. A gyrator comprising:

a gyrotropic substrate;

first and second substantially parallel conductors sufficiently proximal to said substrate such that wave fields traversing the conductors interact gyromagnetically with the substrate in a zone of gyromagnetic interaction between said conductors;

a first transducer coupling a first port to first ends of said first and second conductors such that an electromagnetic wave incident at said first port excites first and second partial wave fields propagating in substantially opposite chirality on said conductors with substantially equal amplitude; said first and second partial wave fields undergoing unequal phase changes during propagation through said zone; and a second transducer coupling a second port to second ends of said first and second conductors, such that said first and second partial wave fields of unequal phases reinforce at said second port.

13. The gyrator of claim 12 wherein the resultant difference in phase change for a first electromagnetic wave propagating from said first to said second port and a second wave propagating from said second to said first port is substantially an odd-integer multiple of 180 degrees.

14. The gyrator of claim 12 wherein said first and second partial wave fields are elliptically polarized.

15. The gyrator of claim 12 wherein said conductors are substantially planar.

16. The gyrator of claim 12 wherein said gyrotropic substrate includes a state of magnetization.

17. The gyrator of claim 16 wherein said magnetization is reversible in direction to cause the unequal phase changes of the first and second normal modes to be interchanged, resulting in a reversal of direction of gyrator action.

18. The gyrator of claim 16 wherein said magnetization is variable between forward and reverse saturation levels.

19. The gyrator of claim 12 wherein said second transducer includes a balun structure for compensating for unequal phase changes in the first and second partial wave fields.

20. An electromagnetic device having first and second ports wherein a first electromagnetic wave propagating from the first to the second port and a second electromagnetic wave propagating from the second to the first port undergo respective phase changes which are different by substantially an odd-integer multiple of 180 degrees, said device comprising:

a gyrotropic substrate;

first and second substantially parallel conductors supporting first and second partial wave fields propagating in opposite chirality, said conductors sufficiently proximal to said substrate such that said partial wave fields traversing said conductors interact gyromagnetically therewith;

a first transducer coupling said first port to first ends of said first and second conductors; and a second transducer coupling said second port to second ends of said first and second conductors.

21. The device of claim 20 wherein said first transducer excites said first and second partial wave fields on said conductors with substantially equal phase upon said first electromagnetic wave being incident at said first port.

22. The device of claim 20 wherein said second transducer excites said first and second partial wave fields on the conductors with substantially opposite phases upon said second electromagnetic wave being incident at said second port.

23. The device of claim 20 wherein said first transducer produces constructive interference of said first and second partial wave fields of substantially equal phase at said first port.

24. The device of claim 20 wherein said second transducer produces constructive interference of said first and second partial wave fields of substantially opposite phase at said second port.

25. A method for forming an electromagnetic device having first and second ports such that a first electromagnetic wave propagating from the first to the second port and a second electromagnetic wave propagating from the second to the first port undergo respective phase changes which are different by substantially an odd-integer multiple of 180 degrees comprising the steps of:

disposing first and second substantially parallel conductors supporting first and second partial wave fields of substanially equal amplitude propagating in opposite chirality in sufficient proximity with a gyrotropic substrate such that said partial wave fields traversing said conductors interact gyromagnetically therewith;

coupling a first transducer between said first port and first ends of said first and second conductors; and coupling a second transducer between said second port and second ends of said first and second conductors.

26. An electromagnetic device comprising:

first and second substantially parallel conductors for supporting first and second elliptically polarized normal-mode wave fields propagating in substantially opposite chirality;

a first transducer coupling a first port to the first and second conductors such that an electromagnetic wave incident at the first port excites first and second normal-mode partial wave fields on the conductors;

a gyrotropic medium sufficiently proximal to the conductors to introduce gyromagnetic interaction with the wave fields, said gyromagnetic interaction causing unequal phase change of the first and second partial wave fields during propagation; and a second transducer coupling the first and second conductors to a second port, said second transducer including a balun structure such that the unequal phases of the partial wave fields arriving at the second transducer are compensated so as to constructively interfere at the second port, the resultant difference in phase change on transmission for a first wave propagating from the first to the second port and a second wave propagating from the second to the first port being substantially an odd-integer multiple of 180 degrees.

27. An electromagnetic device comprising:

first and second substantially parallel conductors for supporting first and second elliptically polarized normal-mode wave fields propagating in substantially opposite chirality;

a first transducer coupling a first port to the first and second conductors such that an electromagnetic wave incident at the first port excites first and second normal-mode partial wave fields on the conductors;

a gyrotropic medium having a state of magnetization which is variable between forward and reverse saturation levels, sufficiently proximal to the conductors to introduce gyromagnetic interaction with the wave fields, said gyromagnetic interaction causing unequal phase change of the first and second partial wave fields during propagation; and a second transducer coupling the first and second conductors to a second port, such that the unequal phases of the partial wave fields arriving at the second transducer are compensated so as to constructively interfere at the second port, the resultant difference in phase change on transmission for a first wave propagating from the first to the second port and a second wave propagating from the second to the first port being substantially an odd-integer multiple of 180 degrees.

28. A gyrator comprising:

a gyrotropic substrate having a state of magnetization which is variable between forward and reverse saturation levels;

first and second substantially parallel conductors sufficiently proximal to said substrate such that wave fields traversing the conductors interact gyromagnetically with the substrate in a zone of gyromagnetic interaction between said conductors;

a first transducer coupling a first port to first ends of said first and second conductors such that an electromagnetic wave incident at said first port excites first and second partial wave fields propagating in substantially opposite chirality on said conductors; said first and second partial wave fields undergoing unequal phase changes during propagation through said zone; and a second transducer coupling a second port to second ends of said first and second conductors, said second transducer including a balun structure such that said first and second partial wave fields of unequal phases reinforce at said second port.

29. A gyrator comprising:

a gyrotropic substrate having a state of magnetization which is variable between forward and reverse saturation levels;

first and second substantially parallel conductors sufficiently proximal to said substrate such that wave fields traversing the conductors interact gyromagnetically with the substrate in a zone of gyromagnetic interaction between said conductors;

a first transducer coupling a first port to first ends of said first and second conductors such that an electromagnetic wave incident at said first port excites first and second partial wave fields propagating in substantially opposite chirality on said conductors; said first and second partial wave fields undergoing unequal phase changes during propagation through said zone; and a second transducer coupling a second port to second ends of said first and second conductors, such that said first and second partial wave fields of unequal phases reinforce at said second port.

* * * * *